United States Patent [19]

Kalibjian

[11] 4,243,878

[45] Jan. 6, 1981

[54] ULTRA-FAST FRAMING CAMERA TUBE

[76] Inventor: Ralph Kalibjian, 1051 Batavia Ave., Livermore, Calif. 94550

[21] Appl. No.: 813,762

[22] Filed: Jul. 7, 1977

[51] Int. Cl.[2] ..... H01U 31/50

[52] U.S. Cl. ..... 250/213 VT; 313/99

[58] Field of Search ..... 250/213 R, 213 VT, 207; 313/94, 99, 102

[56] References Cited

U.S. PATENT DOCUMENTS

| | | | |
|---|---|---|---|
| 3,735,140 | 5/1973 | Stimler | 250/213 VT |
| 3,796,901 | 3/1974 | Mayer et al. | 313/99 |
| 4,012,657 | 3/1977 | Loty | 250/213 VT |

*Primary Examiner*—David C. Nelms

[57] ABSTRACT

An electronic framing camera tube features focal plane image dissection and synchronized restoration of the dissected electron line images to form two-dimensional framed images. Ultra-fast framing is performed by first streaking a two-dimensional electron image across a narrow slit, thereby dissecting the two-dimensional electron image into sequential electron line images. The dissected electron line images are then restored into a framed image by a restorer deflector operated synchronously with the dissector deflector. The number of framed images on the tube's viewing screen is equal to the number of dissecting slits in the tube. The distinguishing features of this ultra-fast framing camera tube are the focal plane dissecting slits, and the synchronously-operated restorer deflector which restores the dissected electron line images into a two-dimensional framed image. The framing camera tube can produce image frames having high spatial resolution of optical events in the sub-100 picosecond range.

14 Claims, 5 Drawing Figures

RESTORER DRIVER
DELAY
DISSECTOR DRIVER
TRIGGER GENERATOR
V1
V2
V3
V4
V5

ULTRA-FAST FRAMING CAMERA TUBE

BACKGROUND OF THE INVENTION

The invention described herein was made in the course of, or under, U.S. Energy Research and Development Administration Contract No. W-7405-ENG-48 with the University of California.

Spatially-resolved records of time-varying optical events are usually obtained with motion picture cameras or electro-optical image tubes as described in *High Speed Photography* by R. F. Saxe (The Focal Press, New York, 1966). The fastest framing speed of a mechanically-shuttered motion picture camera is about one microsecond per frame. Similar frame speeds are possible using raster scanning techniques on image dissector tubes or vidicon-type tubes, as described in *Television* by V. K. Zworykin and G. A. Morton (second edition, John Wiley and Sons, New York, 1954). Faster speeds to one nanosecond frame period are achievable with an electronically-shuttered tube as described in *Applied Optics,* 4, 1155 (FIG. 7) (1965) by E. K. Zavoisky and S. D. Fanchenko.

Still higher camera speeds in the picosecond range can be obtained with electronic streak cameras, as described in U.S. Pat. No. 3,761,614 (Sept. 25, 1973) by D. J. Bradley, but only at the sacrifice of spatial resolution in the image frame. A modified streak camera, described in an article by J. C. Cheng, L. G. Multhauf, and G. R. Tripp appearing in the *Proceedings of the 12th International Congress on High Speed Photography* at Toronto, Canada, Aug. 1976 (SPIE, Bellingham, Washington, 1977), employs an imaging array coupler to produce ultra-fast frames with very limited spatial resolution in the framed images.

The prior art represents a compromise between framing speed and spatial resolution. Ultra-fast framing speeds are obtainable, but only at the sacrifice of spatial resolution. On the other hand, high spatial resolution can be achieved only by a considerable reduction in framing speed. The combination of ultra-fast framing speed and high spatial resolution has heretofore been unobtainable in a single apparatus.

SUMMARY OF THE INVENTION

The present invention provides a framing camera tube that combines ultra-fast framing speed with high spatial resolution in the framed images. Framing speed is in the sub-100 picosecond range, an order of magnitude faster than prior framing tubes with electronically-controlled shutters. The invention has general utility in recording the spatial-temporal characteristics of ultra-short light pulses. In particular, the invention is useful for recording the spatial-temporal characteristics of ultra-short light pulses from lasers and other radiation sources, for the observation of pulsed x-rays and other radiation from nuclear weapon tests, and as a diagnostic tool in laser-fusion research.

In accordance with the present invention, the framing camera tube consists of (1) a dissector section that dissects a two-dimensional electron image into line images, and (2) a restorer section that restores the line images into framed images at a viewing screen. The slit aperture plate that performs the image line dissection is a focal plane anode, and it provides a multiplicity of framed images with each image corresponding to a single slit. The high energy electron line images emanating from the slits are subsequently focused onto the viewing screen. This can be accomplished only when the large transverse energies of the electrons are removed by compensator plates located behind the slits in the restorer section of the tube. Either linear or circular image scanning can be performed in this tube depending upon the geometrical arrangement of the dissecting slits and the deflectors.

It is therefore an object of the present invention to provide a framing camera tube to be used in a system that records a multiplicity of time sequential framed images, each with a framing period in the sub-100 picosecond range.

Other objects of the invention will become apparent from the following detailed description made with reference to the accompanying drawings.

BRIEF DESCRIPTION OF THE DRAWINGS

FIG. 1(*a*) shows a face-on view of the slit aperture plate for linear image scanning. FIG. 1(*b*) shows a face-on view of the electron image formed at the photocathode.

DETAILED DESCRIPTION OF THE INVENTION

Figures 1, 1A, 1B, 3:
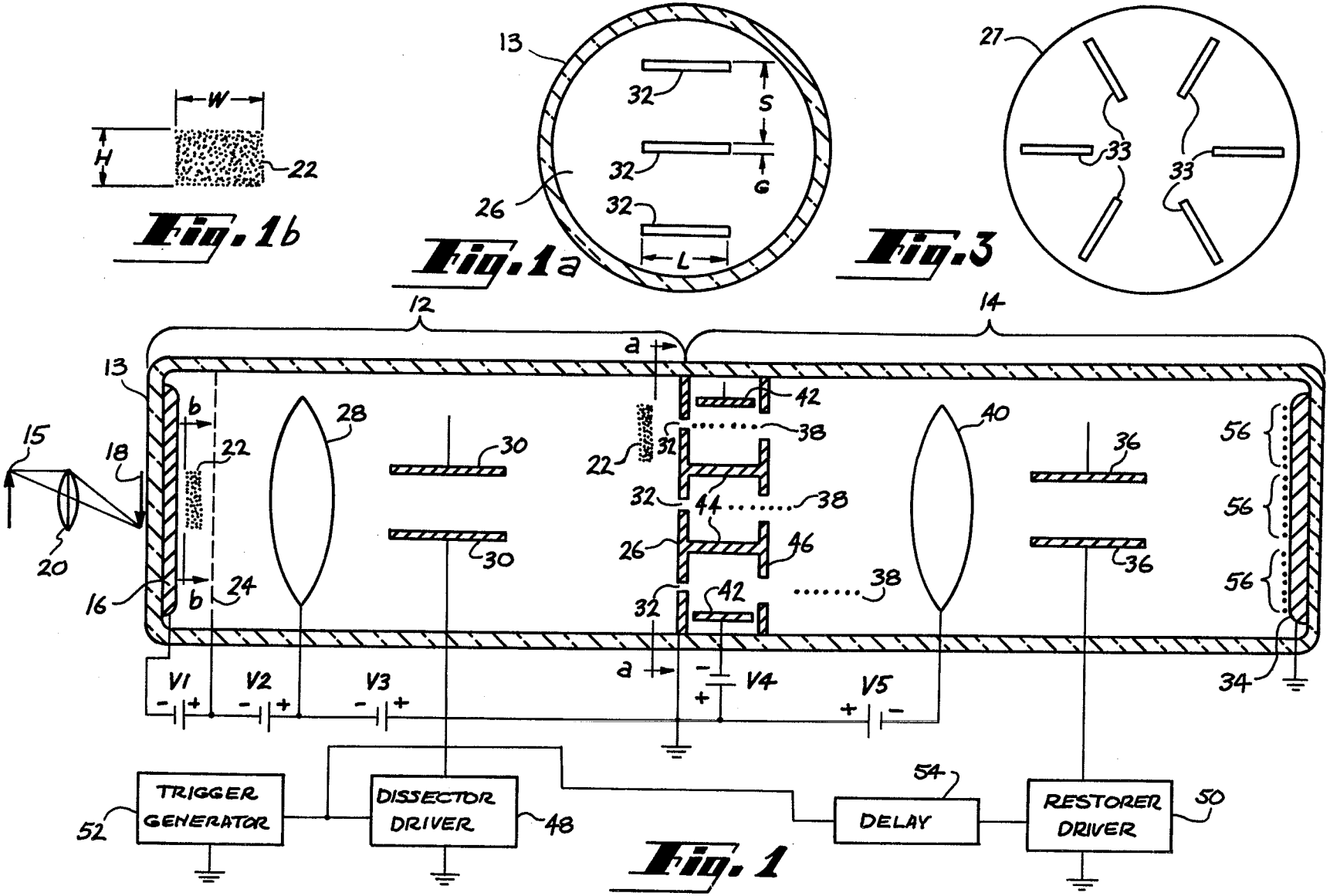
FIG. 1 schematically shows a three-frame tube with the ancillary electronics necessary to operate the tube.
FIG. 3 shows a face-on view of the aperture plate with radial slits for circular image scanning.

FIG. 1 shows a framing camera tube which provides three framed images of a radiant time-varying object or event. The specific showing of three image frames is solely for illustrative purposes, and any number of framed images can be provided as will be discussed hereinafter. The tube 13 consists of a dissector section 12 and a restorer section 14. The dissector section 12 includes a suitable photocathode 16 for converting a photon image 18 focused thereon into a corresponding electron image 22. Photon image 18 is formed by an optical lens 20 which focuses a radiant time-varying object or event 15 onto photocathode 16. The term "radiant" is intended to mean any form of emitted electromagnetic energy such as visible light, infrared light, ultraviolet light, x-rays, etc. The electron image 22 from photocathode 16 is accelerated by a grid electrode 24 (either an open-grid or mesh-grid type) maintained at positive voltage V1 with respect to photocathode 16, and focused onto a slit aperture plate 26 by an electron lens 28 (schematically shown) which may be of either the electrostatic or magnetic type; an electrostatic type lens is assumed hereinafter for discussion purposes. Electron lens 28, shown schematically in the figure, is maintained at a positive voltage V2 with respect to grid electrode 24, and the slit aperture plate 26 is maintained at a positive voltage V3 with respect to the focus element of electron lens 28. A set of dissector deflectors 30 linearly sweeps electron image 22 across an array of dissecting slits 32 formed in aperture plate 26 to form sequential electron line images 38. The linear sweep is synchronized with the start of time-varying event 15 by means of a trigger generator 52 and a dissector driver 48. As shown in FIG. 1(*a*), dissecting slits 32 are spaced parallel to one another on aperture plate 26; slits 32 are also in parallel alignment with dissector deflector 30.

The slit width, G, of slits 32 is less than the spatial resolution in the dissector section 12. The slit length, L, of slits 32 is equal to the width of electron image 22 after being focused by electron lens 28 onto aperture plate 26. In other words, L=WM, where W is the original width of electron image 22 (see FIG. 1(*b*)), and M is the magnification of electron lens 28. The spacing, S, between slits 32 will depend on the format of the desired presentation, but slits 32 will generally be equally spaced to give framed images that are equally spaced in time. The condition S<HM corresponds to frames overlapping in time (H equal to the original height of electron image 22 as shown in FIG. 1(*b*)). Frames overlapping in time need not necessarily be spatially overlapped on the viewing screen with proper design of restorer section 14. The condition S>HM corresponds to image frames which do not overlap in time, generally the most useful mode of operation.

The restorer section 14 includes a viewing screen 34 maintained at the same voltage as slit aperture plate 26. A restorer deflector 36 is disposed parallel to slits 32, and is located between aperture plate 26 and screen 34 for linearly sweeping (in synchronism with dissector deflector 30) electron line images 38 across viewing screen 34. A restorer electron lens 40 (schematically shown) focuses electron line images 38 on screen 34, and compensator plates 42 are disposed parallel to slits 32 and located between aperture plate 26 and restorer lens 40. Compensator plates 42 minimize the transverse velocities acquired by electrons in traversing dissector deflector 30; the compensator plates also minimize the curvature defect at viewing screen 34, thereby allowing the use of a flat-faced screen. Restorer section 14 also includes channel plates 44 with a corresponding large-aperture plate 46 for preventing fringing fields from compensator plates 42 from perturbing adjacent channels, as well as for minimizing perturbations in restorer lens 40. Compensator plates 42 are normally biased at a negative voltage V4 with respect to slit aperture plate 26. The focus element of restorer lens 40 is maintained at a negative voltage V5 with respect to aperture plate 26. The viewing screen 34 can be coated with a suitable phosphor, or can also be a self-scanned electrical readout screen such as a charge-coupled device array, a charge injection device array, a solid-state diode array, or other device arrays that can be directly irradiated with the electron framed images.

A linear array of dissecting slits 32 is not the only configuration possible. The array of slits can take any non-linear configuration, e.g., a spiral array, or, as shown in the slit aperture plate 27 in FIG. 3, a circular array having a series of slits 33 disposed radially to the tube axis for a circular scanned framing camera tube. For a non-linear scan tube the dissector deflector 30 and the restorer deflector 36 will assume a geometry compatible with the particular form of non-linear scan, e.g., in a spiral or a circular scan tube two orthogonal sets of deflectors could be used in the dissector section 12 and the restorer section 14 of the tube. An important advantage occurs in the use of a circular scanned array of dissecting slits 33; time synchronization of the dissector deflector 30 and the restorer deflector 36 with the start of optical event 15 is not required. The deflectors 30 and 36 can be free-running, provided the time duration of optical event 15 is less than the time period of the circular scan. For the circular scanned tube the compensator plates are disposed radially and in parallel alignment to the slits 33. Also, channel plates with the corresponding large-aperture plate (the radial counterpart of electrodes 44 and 46 of the linear scanned tube) are disposed radially and in alignment with the slits 33; this prevents fringing fields from the radially disposed compensator plates from perturbing adjacent channels, as well as minimizing perturbations in the restorer electron lens.

Fast rise-time electric fields are applied in synchronism to both deflectors 30 and 36 by the dissector driver 48 and the restorer driver 50. The drivers 48 and 50 are triggered by generator 52 which in turn is synchronized to optical event 15. An appropriate signal delay 54 (equal to the electron transit time between the dissector deflector 30 and the restorer deflector 36) is introduced in the trigger signal line between the restorer driver 50 and the trigger generator 52. Methods for generating and applying fast rise-time electric fields to deflectors in image camera tubes are described in the *Proceedings of the* 10*th International Congress on High-Speed Photography* (Association Nationale de la Recherche Technique, p. 127, 1972) by S. W. Thomas, G. R. Tripp, and L. W. Coleman.

Figure 2:
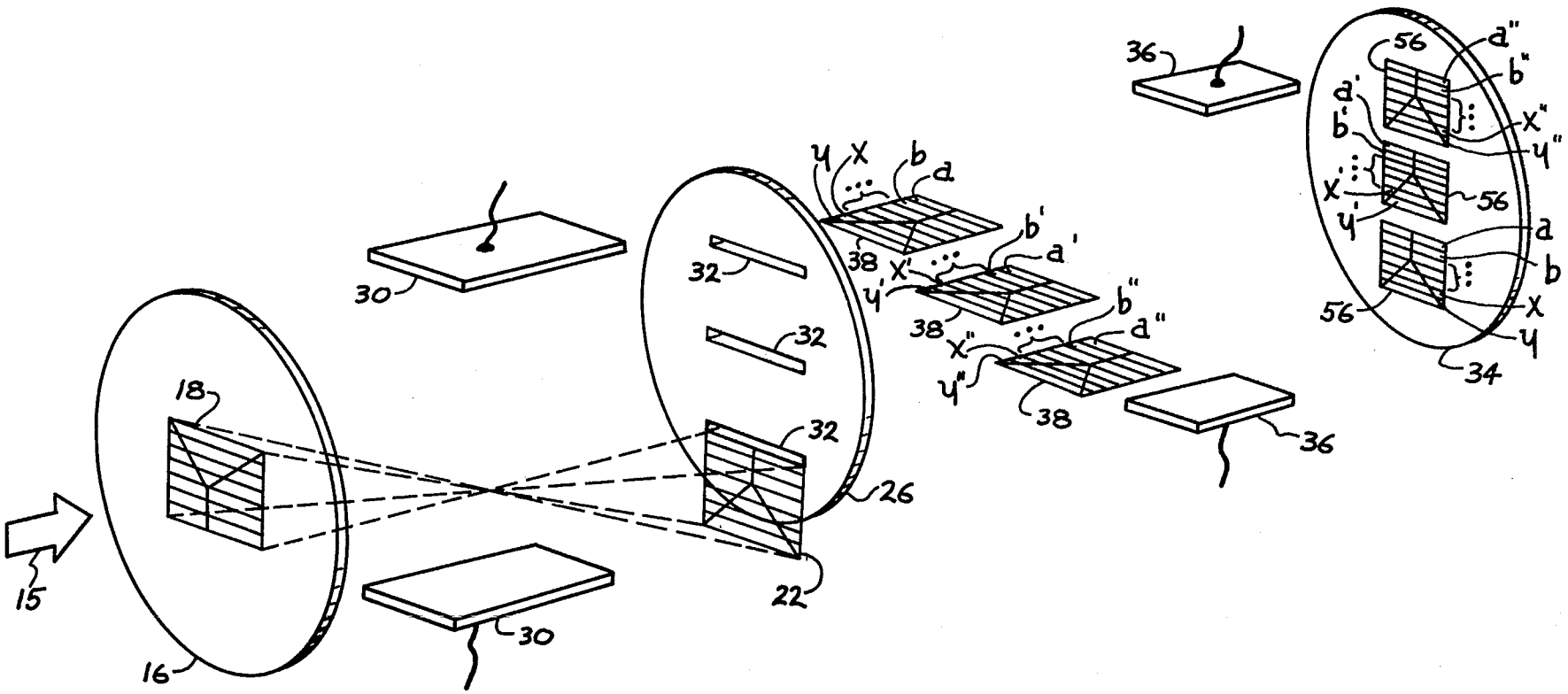
FIG. 2 shows a three-dimensional perspective view of the framing camera tube that illustrates the principle of operation of the tube. The extraction mesh grid electrode, the electron-optical lenses, and the compensator plates are not shown in this figure for clarity.

To illustrate the basic operating features of the invention, a three-frame tube will be described; however, more frames can be included in the tube as desired. A simplified diagram in FIG. 2 illustrates the basic principles of image dissection and restoration in a three-frame tube. Details of the electron lenses 28 and 40, the compensator plates 42 with their corresponding assembly structures 44 and 46, and the accelerating grid 24 (as shown in FIG. 1) are not shown in FIG. 2 for clarity in describing the principle of operation. A time-varying radiant event 15 in figure of a letter y is imaged onto photocathode 16 which converts photon image 18 into a corresponding electron image 22. Dissector deflector 30 linearly sweeps the electron image 22 upwards across slits 32 in aperture plate 26, thereby dissecting image 22 line-by-line to form sequential electron line images 38. As mentioned previously, the linear sweep of dissector deflector 30 is synchronized with the start of time-varying event 15. The framing concept is based upon the line-dissection of an electron image 22 through slits 32, and the restoration of the resulting electron line image 38 at the viewing screen 34 by utilizing synchronized deflection in both the dissector deflector 30 and the restorer deflector 36. Thus, a linear sweep signal on the dissector deflector 30 moves the resulting electron image 22 across one of the slits 32, such as to dissect the electron image 22 across its width, W, into a series of line images 38, a″,b″, . . . ,x″,y″. The series of electron line images 38, a″,b″, . . . ,x″,y″ must now be unfolded with respect to time. This is done in the restorer section 14, where a linear sweep signal on the restorer deflector 36 in synchronism with the dissector deflector 30 moves the image lines 38, a″,b″, . . . ,x″,y″ downwards across the viewing screen 34, to thereby render a framed image 56 of the radiant event 15 to be recorded. After its dissection by a slit 32, the electron image 22 is moved by the dissector deflector 30 across the next slit 32, and the process repeats with electron line images 38, a′,b′, . . . x′,y′. Each framed electron image 56 on viewing screen 34 corresponds to a slit 32; hence, the number of framed images 56 equals the number of slits 32 in the slit aperture plate 26. Multiple frames spaced equally in time are thus generated by sweeping linearly the electron image 22 across the array of slits 32. The ultra-high framing speed (sub-100 picosecond range) of the present invention is achieved by employing very high speed deflection, and an electron-optical configuration that minimizes electron transit-time dispersion in the tube.

The present dissector-type framing camera tube is to be distinguished over shutter-type framing tubes as described in *Applied Optics*, 4, 1155 (FIG. 7) (1965) by E. K. Zavoisky and S. D. Fanchenko. First, in the shutter-type tube a single large aperture is used to shutter the electron image; the aperture plate is not an image (or focal) plane as it is in the dissector-type tube. Second, in the shutter-type tube a frame deflector is used to obtain multiple framed images, whereas in the dissector-type tube multiple narrow slits are used for obtaining the multiple framed images.

The temporal resolution of a framed image in the shutter-type tube is equal to the time required to sweep the electron bundle through the single large aperture, because the beam electrons from all points in the object become spatially mixed at the aperture as a consequence of the aperture plate not being an image plane. In the dissector-type tube, the aperture plate 26 is located on the image plane; thus, for a slit width equal to the spatial resolution in the dissector section 12 of the tube, the temporal resolution of a line is equal to the time required to sweep a resolvable line through a slit width. Therefore, the framed image 56 at the viewing screen 34 is formed line-by-line when the intermediate focused image is dynamically swept across the slit 32. The temporal resolution in the dissector-type tube is greater than that in the shutter-type tube. Each dissected line (corresponding to the spatial resolution in the intermediate image) is well focused and has a temporal resolution similar to that found in a streak camera tube; however, the framed image 56 is scanned linearly in time, i.e., a time delay occurs between the first and last lines of the frame. As an example, for a unity magnification system, a spatial resolution of 50 microns, and a scan rate of 33 microns per picosecond, the frame is tilted obliquely in time with a frame period of 90 picoseconds for a 4×3 millimeter sized frame. If necessary, in a multiple-slit, dissector-type tube of the present invention, computation techniques could be used to obtain single-timed frames.

In the prior shutter-type framing tube, the temporal resolution, $\tau_{sf}$, of the single framed image is given by $$\tau_{sf} = \tau_{sl} = \sqrt{\tau_a^2 + \tau_t^2} \quad (1)$$

where $\tau_a$ is the aperture frame period, and $\tau_t$ is the electron transit-time dispersion in the tube. The temporal resolution, $\tau_{sl}$, of a spatially resolvable line in the frame is also given by Equation (1) because the time information for a line is integrated during the frame period.

The present dissector-type framing tube offers better temporal resolution. Here, the temporal resolution, $\tau_{dl}$, of a line in the framed image is given by $$\tau_{dl} = \sqrt{\tau_l^2 + \tau_t^2} \quad (2)$$

where $\tau_l$ is the time required to sweep the resolvable line (of the intermediate image) across the slit 32. For the previously given example, $\tau_l = 1.5$ picoseconds, $\tau_f = 90$ picoseconds, and assuming $\tau_t = 10$ picoseconds, $\tau_{dl} = \sqrt{1.5^2 + 10^2} = 10.1$ picoseconds for the dissector-type and $\tau_{sl} = \sqrt{90^2 + 10^2} = 90.6$ picoseconds for the shutter-type tube. The frame period for both types of tubes are identical; however, the dissector-type tube gives greater temporal and spatial resolution within the frame period.

Within certain limitations, the temporal resolution in the shutter-type tube can be improved by decreasing the aperture size; however, for a given electron lens, the f-stop number will be larger and the field of view will be smaller. By comparison, in the dissector-type tube, the constraints in the f-stop number and the field of view do not occur. In the dissector-type tube, the slit length, L, is made equal to the intermediate image size, WM, and thus the field of view depends only on the dissector deflector voltage. Also, because of the intermediate image at the aperture plate 26, the brightness through the slit 32 is not limited, as in the case of the single lens shutter-type tube.

Normally, when the slit width, G, is made less than the spatial resolution in the tube, the electron line images 38 emanating from the slits 32 are imaged onto the viewing screen 34 by the restorer lens 40. Framed images 56 in the same orientation, or in a left-to-right orientation, with respect to the radiant event 15 can be obtained for either zero or 180 degrees (plus a phase angle equivalent to the electron transit time between the dissector deflector 30 and the restorer deflector 36) synchronism of the restorer deflector 36 with respect to the dissector deflector 30. However, for the tube geometry shown in FIG. 1, multiple frames are best obtained when the restorer deflector waveform is in 180 degrees synchronism with respect to the dissector deflector waveform. Also, the framed image 56 aspect ratio can be adjusted by varying the sweep voltage rate of the restorer deflector 36 with respect to the dissector deflector 30.

However, the spatial resolution of the framed image 56 is degraded when the slit width, w, is made greater than the spatial resolution in the tube. For the tube geometry shown in FIG. 1, the degradation can be corrected by sweeping the electron line image 38 at the restorer deflector 36 in zero degree synchronism with respect to the dissector deflector waveform. Unstreaked framed images 56 are achieved on the viewing screen 34 when the sweep voltage rate, $A_r$, at the restorer deflector 40 is given by $$A_r = M_r D_d P_r A_d / D_r P_d \quad (3)$$

where $A_d$ is the sweep voltage rate at the dissector deflector, $M_r$ is the magnification in the restorer section 14, P and D are the deflector plate length and separation, respectively, and the subscripts refer to the dissector (d) and restorer (r) sections 12 and 14, respectively.

In a framing camera tube in accordance with the invention, 135 picosecond duration framed images were recorded with 20 line pair per millimeter spatial resolution of a 2.5 millimeter sized image at the cathode. A 394 mesh per centimeter extraction grid spaced 2 millimeters from the cathode allowed an electric field greater than 3000 volts per centimeter to be applied at the cathode, and thus minimized the transit-time dispersion in the tube to less than 10 picoseconds. The dissector section used an electrostatic spherical lens system to focus the beam electrons at the slit aperture plate with an energy of 16,000 electron-volts. In the restorer section, a 5 centimeter diameter einzel lens focused the 16,000 electron-volt line images from the slits onto a phosphor-coated screen with a ×2 magnification. Conventionally shaped plates were used for all deflectors, and all plates were aligned parallel to the dissector slits. Approximately −250 volts (with respect to the slit aperture plate) was impressed on the compensator plates to compensate the transverse energy of the electrons, and thus allowed three frames to be imaged at a flat-faced phosphor screen. Sweep rates as high as 1400 volts per nanosecond have already been used at the restorer deflector. The sweep rate at the dissector deflector is adjusted to a lower sweep rate (in accordance with Equation (3) to approximately one-half of the restorer sweep rate) by inserting an inductor in the transmission line driving the dissector deflector. Nominally a 6.5 nanosecond delay (to compensate for electron beam transit time between the dissector deflector and the restorer deflector) is introduced in the trigger signal line to the restorer driver. Faster frame speeds in the sub-100 picosecond range will be obtained when a faster deflection driver is used with a sweep rate greater than 2000 volts per nanosecond. The design of such faster deflection drivers is within the ability of those skilled in the electronics art.

Although the invention has been described with respect to specific embodiments, various modifications may be made therein by those skilled in the art. It is therefore intended that the invention be limited solely by the scope of the following claims.

I claim:

1. A method for obtaining time-resolved, two-dimensional framed images of a time-varying radiant event, comprising the steps of:

(a) converting an incident time-varying photon image of said radiant event into a corresponding time-varying electron image;

(b) dissecting said time-varying electron image into a time-sequential series of electron line-images by sweeping said time-varying electron image past a slitted aperture plate positioned at a focal plane of said electron image;

(c) restoring said time-sequential electron line-images into discrete two-dimensional electron framed images representing the time-variation of said incident photon image; and (d) converting said electron framed images into a display suitable for recording.

2. The method of claim 1, wherein said time-varying electron image is line dissected by linear scanning.

3. The method of claim 2, wherein said time-sequential electron line images are restored into framed images by linear re-scanning.

4. The method of claim 3, wherein said linear scanning and said linear re-scanning are synchronized.

5. The method of claim 1, wherein said time-varying electron image is line-dissected by non-linear scanning.

6. The method of claim 5, wherein said time-sequential electron line-images are restored into framed images by non-linear re-scanning.

7. The method of claim 6, wherein said non-linear scanning and said non-linear re-scanning are synchronized.

8. The method of claim 7, wherein said synchronized non-linear scanning and re-scanning are circular scanning.

9. An ultra-fast framing camera tube, comprising the following combination housed within an evacuated envelope:

(a) a photoemissive cathode for converting an incident time-varying photon image into a corresponding time-varying electron density image;

(b) an aperture plate having a plurality of slits therein;

(c) means for focusing said time-varying electron density image onto said aperture plate, said focusing means being maintained at a negative voltage with respect to said aperture plate;

(d) means for sweeping said focused time-varying electron density image across the slits in said aperture plate, thereby forming a time-sequential series of electron line-images;

(e) means for restoring said time-sequential electron line-images into two-dimensional electron framed images; and (f) means for displaying said electron framed images in a form suitable for recording.

10. The apparatus of claim 9, wherein the slits in said aperture plate are disposed in parallel spaced relation.

11. The apparatus of claim 9, wherein the slits in said aperture plate are disposed in radial spaced relation.

12. The apparatus of claim 9, including means for accelerating said time-varying electron density image from the photoemissive cathode to the aperture plate.

13. The apparatus of claim 9, including means for synchronizing the operation of said sweeping means and said restoring means.

14. The apparatus of claim 13, wherein said synchronizing means is triggered by the arrival of said time-varying photon image at said photoemissive cathode.

* * * * *